US010378734B2

(12) United States Patent
Veltri et al.

(10) Patent No.: US 10,378,734 B2
(45) Date of Patent: Aug. 13, 2019

(54) WALL WASH LIGHT FIXTURE

(71) Applicant: Hubbell Incorporated, Shelton, CT (US)

(72) Inventors: Thomas Veltri, Greenville, SC (US); Dhavalkumar P. Patel, Greer, SC (US); David Rector, Mauldin, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/137,984

(22) Filed: Sep. 21, 2018

(65) Prior Publication Data

US 2019/0024876 A1 Jan. 24, 2019

Related U.S. Application Data

(63) Continuation of application No. 15/491,266, filed on Apr. 19, 2017, now Pat. No. 10,082,275.

(60) Provisional application No. 62/325,653, filed on Apr. 21, 2016.

(51) Int. Cl.

| | |
|---|---|
| ***F21V 21/00*** | (2006.01) |
| ***F21V 17/00*** | (2006.01) |
| ***F21V 5/04*** | (2006.01) |
| ***F21V 15/01*** | (2006.01) |
| *F21S 8/02* | (2006.01) |
| *F21S 8/00* | (2006.01) |
| *F21S 8/04* | (2006.01) |
| *F21S 4/28* | (2016.01) |
| *F21Y 115/10* | (2016.01) |

(52) U.S. Cl.

CPC ..... *F21V 17/002* (2013.01); *F21V 5/04* (2013.01); *F21V 15/01* (2013.01); *F21S 4/28* (2016.01); *F21S 8/02* (2013.01); *F21S 8/033* (2013.01); *F21S 8/04* (2013.01); *F21Y 2115/10* (2016.08)

(58) Field of Classification Search

CPC ..... F21V 5/04; F21V 15/01
USPC ..... 362/311.14, 311.01, 222, 223
See application file for complete search history.

(56) References Cited

U.S. PATENT DOCUMENTS

| | | | | |
|---|---|---|---|---|
| 5,032,958 | A | 7/1991 | Harwood | |
| 5,272,610 | A | 12/1993 | Namenye et al. | |
| 7,484,871 | B2 | 2/2009 | Boxler | |
| 9,222,651 | B1 | 12/2015 | Vlad et al. | |
| 10,082,275 | B2 * | 9/2018 | Veltri | F21V 5/04 |
| 2010/0128485 | A1 | 5/2010 | Teng et al. | |
| 2012/0182734 | A1 | 7/2012 | Shimizu et al. | |

(Continued)

FOREIGN PATENT DOCUMENTS

| | | |
|---|---|---|
| WO | 2015031322 | 3/2015 |

*Primary Examiner* — Laura K Tso
(74) *Attorney, Agent, or Firm* — Michael Best & Friedrich, LLP

(57) ABSTRACT

A wall wash light fixture includes a housing having an upper wall, a first side wall, and a second side wall at least partially defining an interior. The first side wall and the second side wall each include a first mounting feature having a projection extending into the interior. A mounting bracket is positioned in the interior and releasably connected to the housing. A light emitter is connected to the mounting bracket. A lens has a base, a first arm extending from the base, and a second arm extending from the base. The first and second arms each include a second mounting feature configured to mate with the first mounting feature to releasably connect the lens to the housing.

20 Claims, 10 Drawing Sheets

(56) References Cited

U.S. PATENT DOCUMENTS

| | | | |
|---|---|---|---|
| 2012/0300452 | A1 | 11/2012 | Harbers et al. |
| 2013/0094225 | A1 | 4/2013 | Leichner |
| 2014/0268736 | A1 | 9/2014 | Ratkus et al. |
| 2015/0124440 | A1 | 5/2015 | Janjua et al. |
| 2015/0292719 | A1 | 10/2015 | Park |
| 2015/0330595 | A1 | 11/2015 | Grigore |
| 2016/0169481 | A1 | 6/2016 | Horvath |

* cited by examiner

WALL WASH LIGHT FIXTURE

RELATED APPLICATION(S)

This application is a continuation of U.S. patent application Ser. No. 15/491,266, filed Apr. 19, 2017, which is based on U.S. Provisional Application Ser. No. 62/325,653, filed Apr. 21, 2016, the disclosure of which is incorporated herein by reference in its entirety and to which priority is claimed.

FIELD

Various exemplary embodiments relate to light recessed wall-wash fixtures.

BACKGROUND

Light fixtures, or luminaires, are used with electric light sources to provide aesthetic and functional housing in both interior and exterior applications. One type of light fixture is a recessed lighting. Recessed lighting fixtures or downlights provide lighting for a space, such as a building or room, and are aesthetically pleasing since the fixtures are advantageously recessed in a support such as a ceiling. Being installed behind a frame or above a ceiling, however, limits accessibility, making it costly and time consuming to repair or replace components in the recessed light fixture.

Some recessed light fixtures, commonly referred to as "wall-wash" light fixtures, are designed to be positioned in a ceiling and direct light at an angle to wall or objects placed along or near a wall's surface. These light fixtures are typically installed with a set lighting direction and light output. If a later change or modification is required, the installed light fixture must be removed and a different fixture installed in its place.

SUMMARY

According to an exemplary embodiment, a wall wash light fixture includes a housing having an upper wall, a first side wall, and a second side wall at least partially defining an interior. The first side wall and the second side wall each include a first mounting feature having a projection extending into the interior. A mounting bracket is positioned in the interior and releasably connected to the housing. A light emitter is connected to the mounting bracket. A lens has a base, a first arm extending from the base, and a second arm extending from the base. The first and second arms each include a second mounting feature configured to mate with the first mounting feature to releasably connect the lens to the housing.

According to another exemplary embodiment, a wall wash light fixture includes a housing having an upper wall, a first side wall, and a second side wall at least partially defining an interior. The first side wall and the second side wall each include a first mounting feature having a projection extending into the interior. A mounting bracket is positioned in the interior and releasably connected to the housing. The mounting bracket includes a mounting surface for receiving the light emitter, a first side wall extending from the mounting portion, a second side wall extending from the mounting portion, a first flange extending from the first side wall, and a second flange extending from the second side wall. A light emitter is connected to the mounting bracket. A lens has a pair of second mounting features configured to mate with the first mounting features to releasably connect the lens to the housing. The lens is field removable from the housing without the use of a dedicated tool.

According to another exemplary embodiment, a wall wash light fixture includes a housing having an upper wall and a side wall at least partially defining an interior. The side wall includes a lower edge and a first mounting feature positioned between the lower edge and the upper wall. A mounting bracket is positioned in the interior. A light emitter is connected to the mounting bracket. A lens includes a base and an arm extending from the base. The arm includes a second mounting feature configured to mate with the first mounting feature to releasably connect the lens to the housing. The arm extends at an oblique angle relative to the base and relative to the side wall.

Another exemplary embodiment is directed to a method of assembling a wall wash light fixture. A housing is selected from one or more housing types. A light emitter mounting bracket is selected from a plurality of mounting brackets, where the different mounting brackets are associated with different light output directions. A lens is selected from a plurality of lenses, where the different lens are associated with different light outputs. The mounting bracket is connected to the housing. The lens is connected to the housing and secured without the use of a dedicated tool.

Another exemplary embodiment is directed to method of modifying the light output of a wall wash light fixture. A first lens having a first light distribution is removed from a housing without the use of a dedicated tool. A second lens having a second light distribution is connected to the housing without the use of a dedicated tool. The housing includes an upper wall, a first side wall, and a second side wall at least partially defining an interior, wherein the first side wall and the second side wall each include a first mounting feature having a projection extending into the interior. The lens includes a base, a first arm extending from the base, and a second arm extending from the base, wherein the first and second arms each include a second mounting feature configured to mate with the first mounting feature to releasably connect the lens to the housing.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
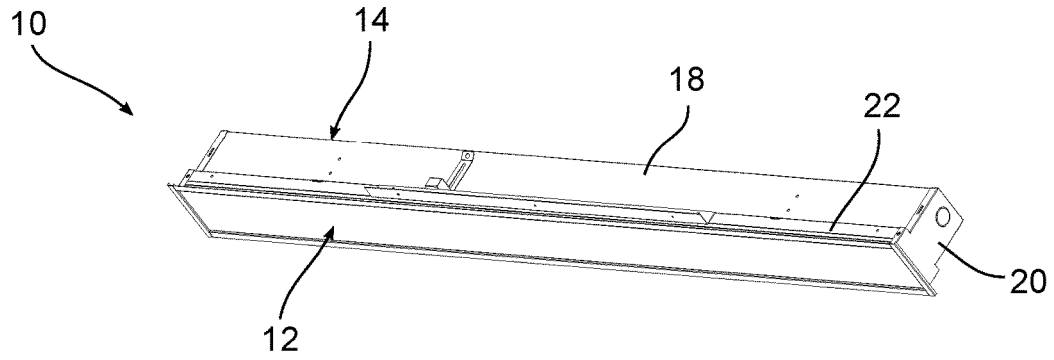
FIG. 1 is a bottom perspective view of an exemplary light fixture.
Figure 2:
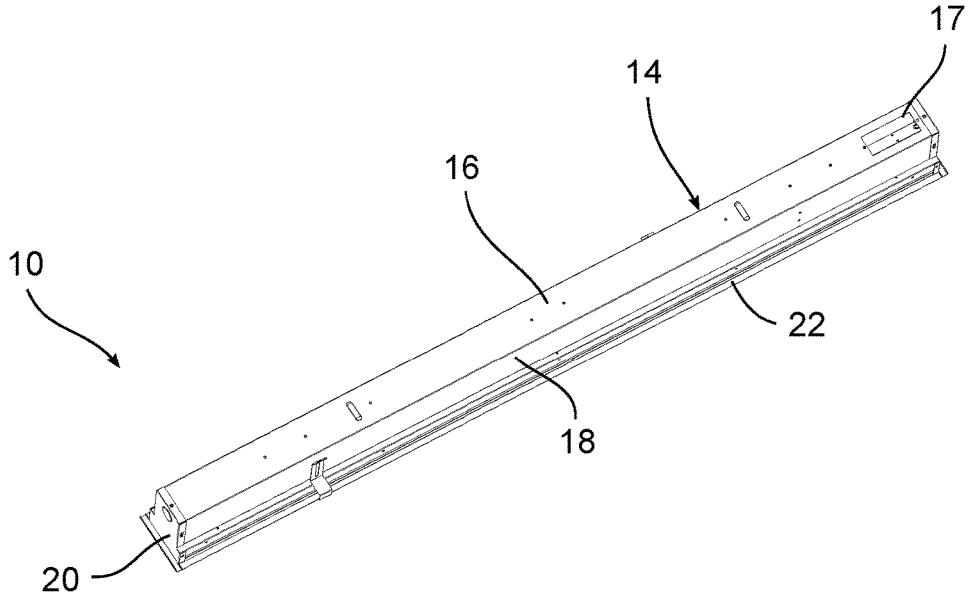
FIG. 2 is a top perspective view of FIG. 1.

FIGS. 1 and 2 show an exemplary wall-wash light fixture 10 that can be installed in a surface, for example a ceiling or a wall. The ceiling can be a drop ceiling. The light fixture 10 can be recessed or surface mounted and is electrically connected to a power source (not shown), such as a mains power supply in a building. The light fixture 10 can be positioned to direct light to a specific area of a room, for example a wall an adjacent wall.

The light fixture 10 includes a lens 12 connected to a housing 14 having one or more upper walls 16, one or more side walls 18, and one or more end walls 20 at least partially defining an interior and an opening. The upper wall 16 and the side walls 18 each have a rectilinear configuration and are oriented at right angles to form a substantially elongated rectangular housing 14. The top wall 16 and side walls 18 can be integrally formed and the end walls 20 can be separately connected. In other embodiments, other rectilinear and curvilinear configurations and orientations can be used and any number of integral or discrete pieces can be used to form the housing 14.

The upper wall 16 can include one or more openings 17 that act as a conduit for one or more electrical connectors to pass into the housing 12. The electrical connectors can be part of, or connected to, a power supply source such as mains power wiring that runs through a building. The opening 17 is shown positioned adjacent a first end of the housing 12, however it can be positioned anywhere along the upper wall 16. One or more openings 17 can also, or alternatively, be provided in the side walls 18.

Light emitters and one or more control components are positioned in the interior of the housing 14. One example of a control component is a driver (not shown) that can be positioned in the housing 14. The driver is connected to a power supply and provides power to the light emitters. Other control components can include fuses, surge protectors, dimmers, and sensors. The control components can be connected in the housing 14, for example using fasteners or other mechanical connectors, or positioned in the housing 14 using brackets or other structural features. The light emitters produce and emit light through an open portion of the housing 14 and through the lens 12. The lens 12 can be plain and completely transparent, or it can include features that direct, diffuse, color, or otherwise alter the light leaving the housing 14.

Dimensions of the housing 14 may be chosen depending on the application, e.g., to accommodate the desired length of light distribution down a given hallway or along a given piece of artwork. However, for example only, in one construction the elongated side walls 18 of the lighting fixture 10 have a length of about 24 inches, or between about 12 to about 36 inches, or between about 18 and about 28 inches, etc.

One or more flanges 22 extend from the side walls 18 to position and/or support the housing 14, for example in a frame. A single continuous flange 22 can extend around the entire housing or multiple discrete flanges can be used extending from one or more of the side walls 18. The flanges 22 are shown as flush with a lower edge of the housing 14, but may also be offset to accommodate ceiling tiles in a drop ceiling. In alternative embodiments, the flange 22 is removed and the housing 14 is mounted in any other suitable manner. One or more brackets can also extend from and be connected to the housing 14 to position or secure the light fixture 10.

Figure 3:
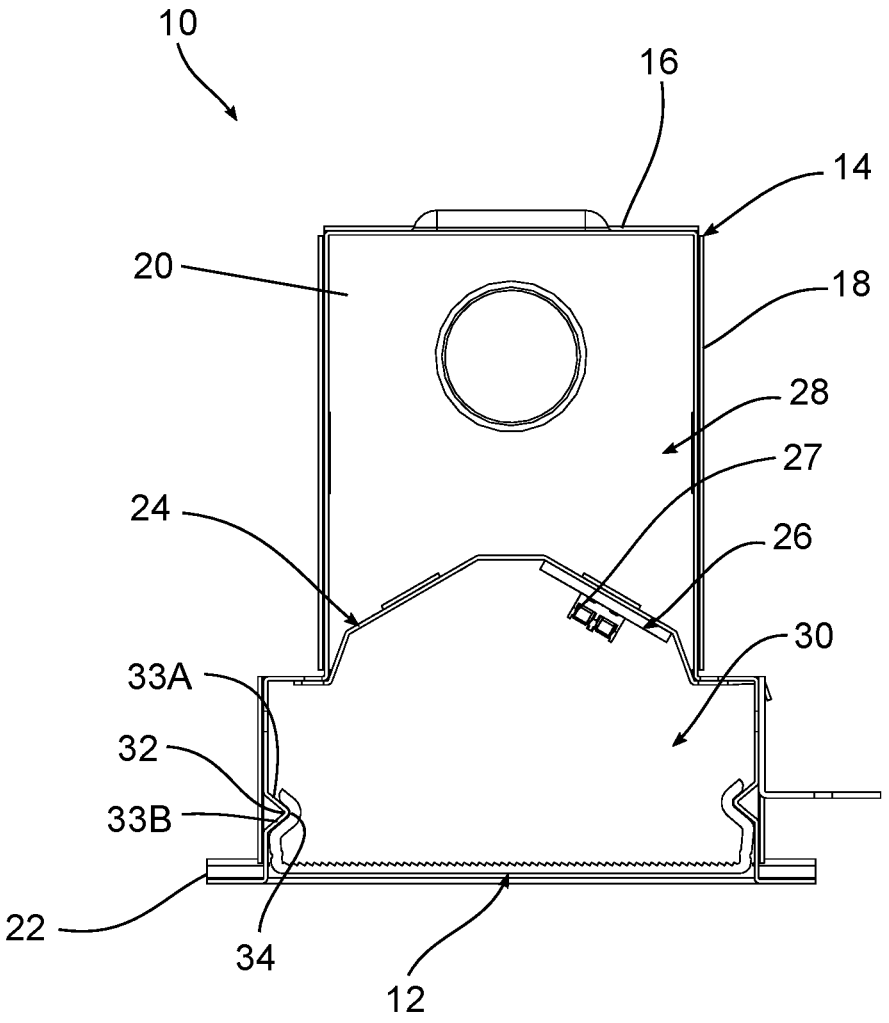
FIG. 3 is a side, sectional view of FIG. 1.
Figure 4:
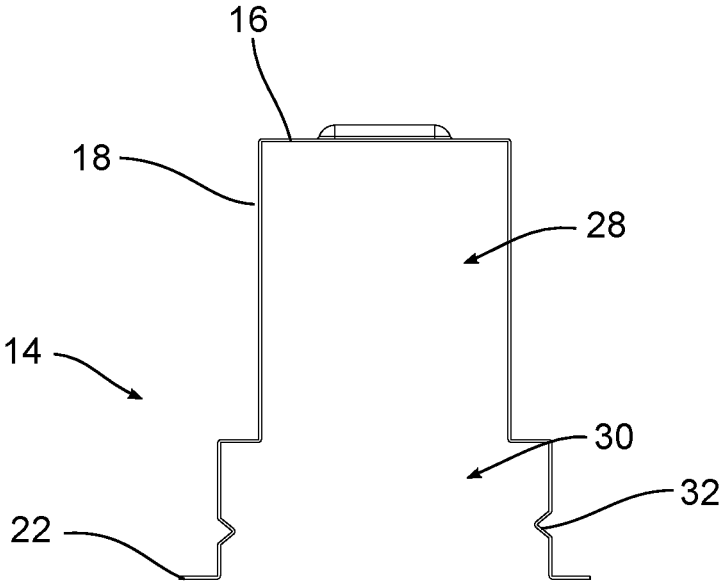
FIG. 4 is a side view of an exemplary housing.
Figure 5:
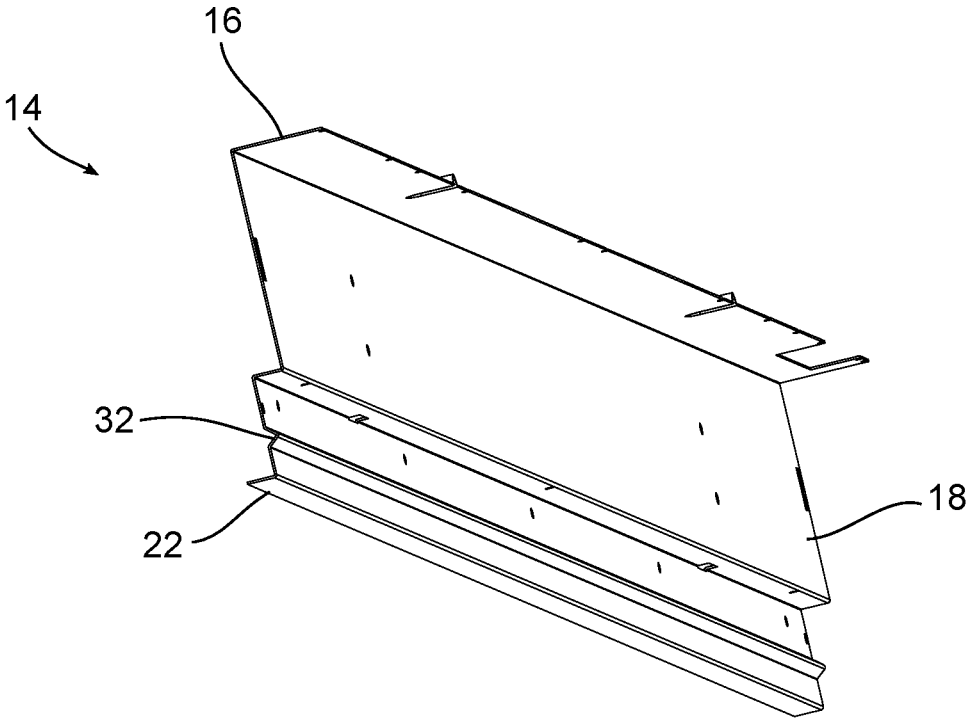
FIG. 5 is a perspective, sectional view of FIG. 4.

FIG. 3 shows an exemplary interior configuration of the light fixture 10. A mounting bracket 24 is positioned in the housing 14. The mounting bracket 24 can be connected to the housing by fasteners or other mechanical connections or through a joining process such as welding. A light emitter 26 is connected to the mounting bracket 24, for example through fasteners such as mounting screws or snap-fit connections. In an exemplary embodiment, the light emitter 26 is an LED board that includes a plurality of LEDs connected to a printed circuit board. The LEDs can be arranged linearly, running the length of the housing 14. A connector 27 is provided on the PCB board to connect the light emitter to one or more control components. Other patterns and groupings of LEDs can be used, and other light sources may also be used.

In various exemplary embodiments, the housing 14 has an upper section 28 and a lower section 30 that is wider than the upper section 28. The upper section 28 can include one or more control components, such as drivers to power the light emitters. The lower section 30 includes a mounting feature for releasably connecting the lens 12 to the housing 14. In an exemplary embodiment, the mounting feature is a V-shaped protrusion 32 that includes a first angled wall 33A and a second angled wall 33B extending from the side wall 18 into the interior of the housing 14. The V-shaped protrusion 32 fits into a corresponding groove 34 on the lens. The groove 34 is at least partially defined by a first angled portion and a second angled portion that mate with the walls of the V-shaped protrusion 32. The mounting feature allows the lens 12 to be easily changed to accommodate different lenses with different light distributions.

In some exemplary embodiments, the mounting feature connects the lens 12 to the housing 14 without any other attachment such as screws, bolts, clips, snap-connectors etc. The lens 12 can therefore be field mounted and field changed by hand without the use of any special tools or dedicated tools. For example, while a tool such as a knife or screwdriver may be used to remove the lens 12, a specific tool is not needed to remove any screws or other fasteners. Positioning the control components in the upper section 28 also allows the lens to be changed without exposure to a high voltage connection of component, such as a high voltage connection between a driver and the power supply.

Figure 6:
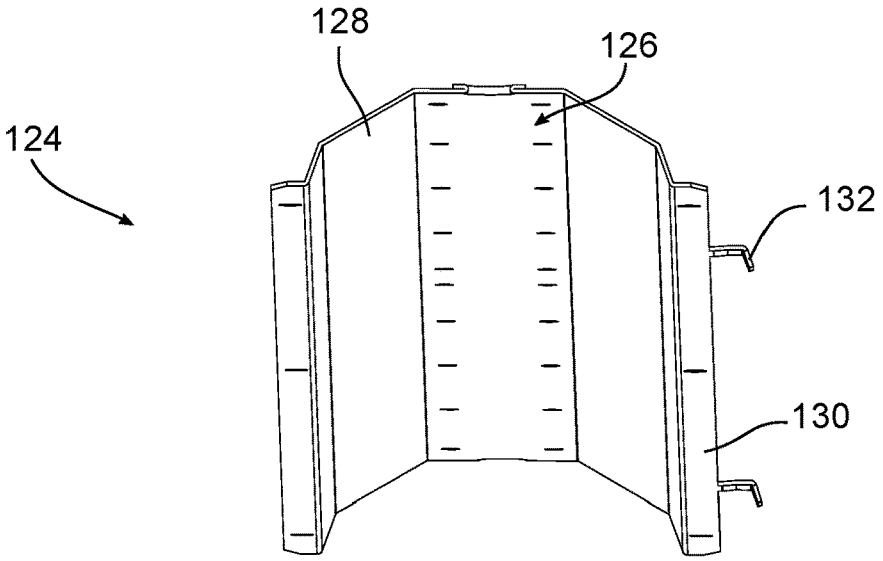
FIG. 6 is a bottom perspective view of an exemplary mounting bracket.

In various exemplary embodiments, different mounting brackets can be connected to the housing 14 to support light emitters 26 in different orientations and to provide different light outputs. FIG. 6 shows an exemplary embodiment of a mounting bracket 124 used to emit light substantially downward from the housing orthogonal to the plane of the lens 12. The mounting portion 126 is oriented substantially perpendicular relative to the opening and the lens 12. The mounting bracket 124 includes a central mounting portion 126 for receiving one or more light emitters 26. A pair of side walls 128 extend from the central mounting portion 126 having a first angled portion and a second angle portion. A pair of side flanges 130 extend from the side walls 128. One or more tabs 132 extend from one of the side flanges 130. The flanges 130 and the tabs 132 are used to connect the mounting bracket 124 to the housing 14. For example, as shown in FIG. 3, one of the flanges 130 can be connected to the housing 14 by fasteners and the tabs 132 can extend through slots in the side wall 18 of the housing 14. The tabs 132 can allow the mounting bracket 124 to pivot with the respect to the housing 14, allowing the mounting bracket 14 to be held in place on a first side while the other side is installed. Fewer or more tabs 132 can be used and the tabs 132 can extend from either or both side flanges 130.

Figure 7:
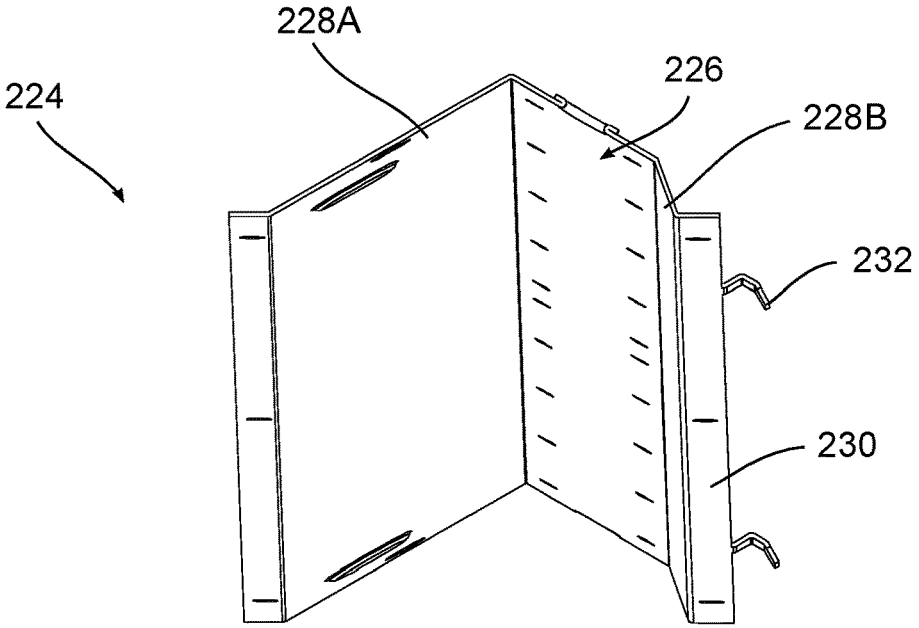
FIG. 7 is a bottom perspective view of another exemplary mounting bracket.

FIG. 7 shows another exemplary embodiment of a mounting bracket 224 used to emit light at an oblique angle to the opening and the lens 12. The mounting bracket 224 includes a mounting portion 226 for receiving a light emitter 26. The mounting portion 226 is oriented at an oblique angle relative to the opening and the lens 12. A pair of angled side walls 228A, 228B extend from the mounting portion 226. The first side wall 228A has a greater length than the second side wall 228B. A pair of side flanges 230 extend from the side walls 228A, 228B and one or more tabs 232 extend from one of the side flanges 230. The tabs 232 are used to connect the mounting bracket 224 to the housing 14. For example, the tabs 232 can extend through slots in the side wall 18 of the housing 14. Fewer or more tabs 232 can be used and the tabs 232 can extend from either or both side flanges 230.

Figure 8:
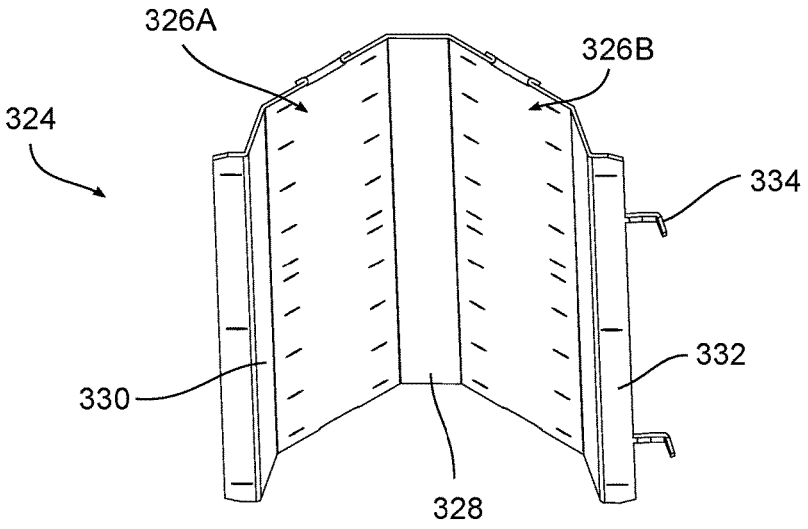
FIG. 8 is a bottom perspective view of another exemplary mounting bracket.

FIG. 8 shows an exemplary embodiment of a mounting bracket 324 that can be used to emit light in one or more directions. The mounting bracket 324 includes a first mounting portion 326A and a second mounting portion 326B for receiving one or more light emitter 26. The first mounting portion 326A is oriented at a first oblique angle relative to the opening and the lens 12. The second mounting portion 326B is oriented at a second oblique angle relative to the opening and the lens 12, with the second oblique angle being substantially opposite from the first. A central wall 328 extends between the first mounting portion 326A and the second mounting portion 326B. A side wall 330 extends from each of the mounting portions 326A, 326B. A pair of side flanges 332 extend from the side walls 330 and one or more tabs 334 extend from one of the side flanges 332. The tabs 334 are used to connect the mounting bracket 324 to the housing 14. For example, the tabs 334 can extend through slots in the side wall 18 of the housing 14. Fewer or more tabs 334 can be used and the tabs 334 can extend from either or both side flanges 332.

Figure 9:
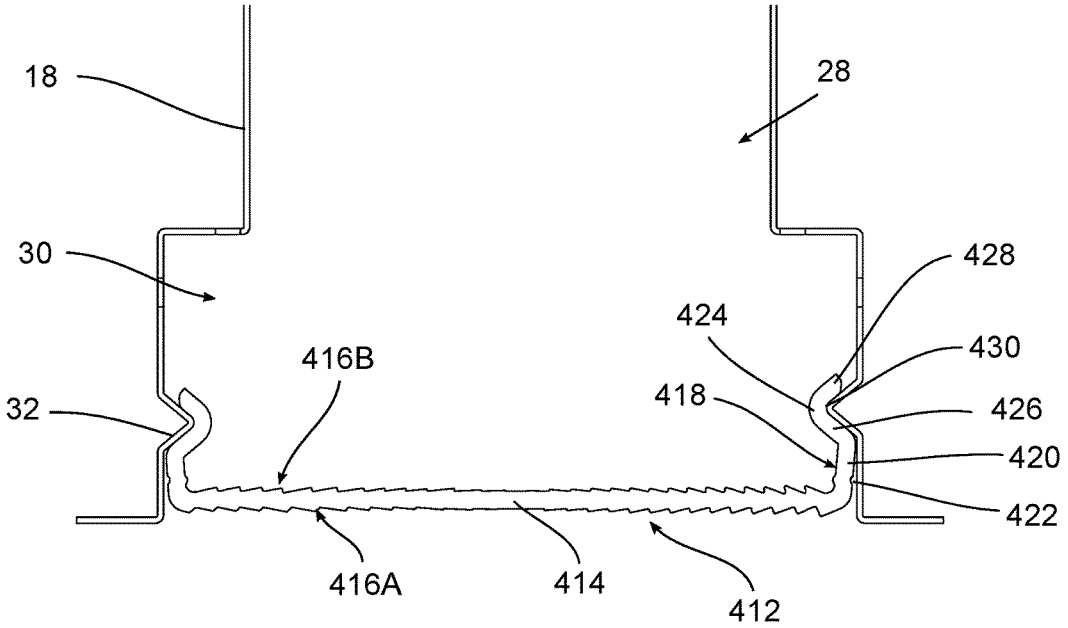
FIG. 9 is a side, sectional view of the housing and an exemplary lens.
Figure 10:
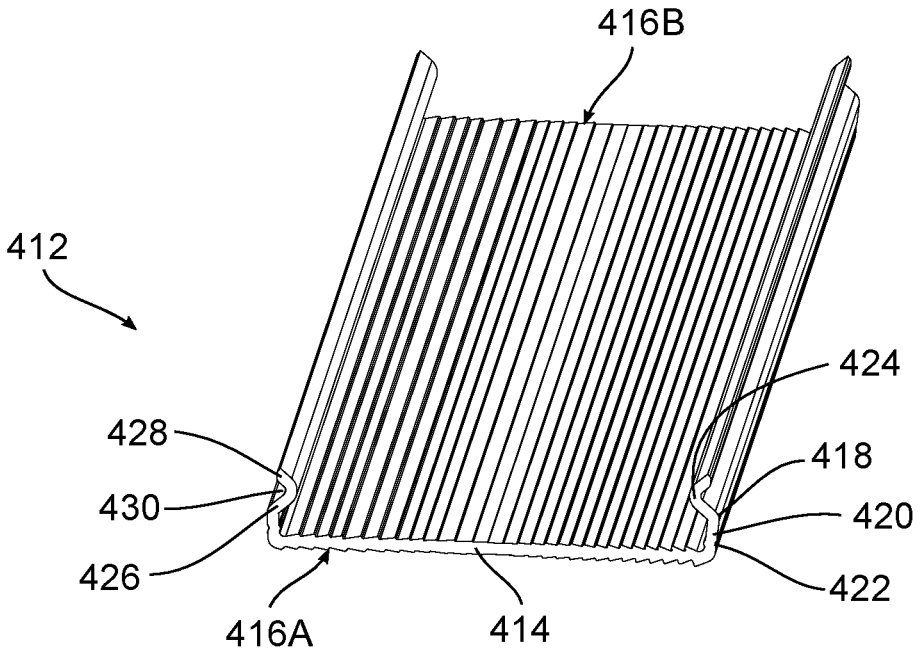
FIG. 10 is a top perspective view of the lens of FIG. 9.
Figure 11:
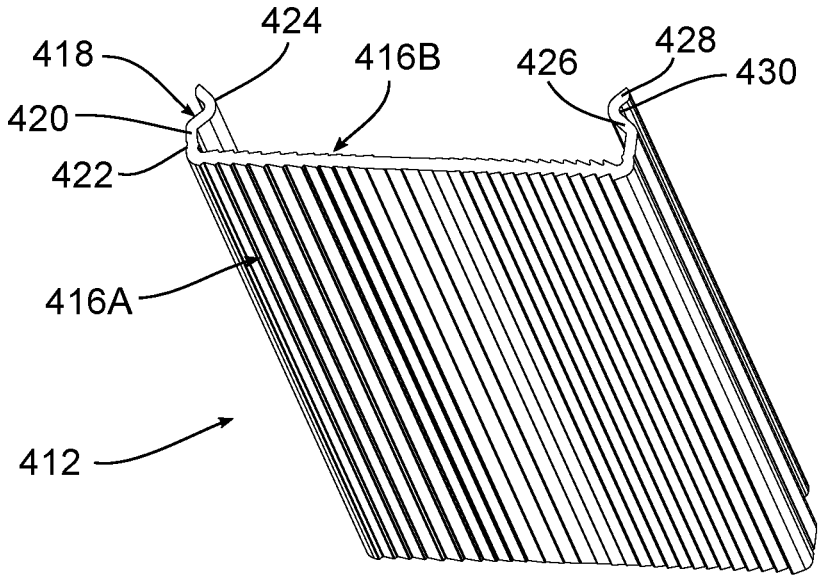
FIG. 11 is a bottom perspective view of the lens of FIG. 9.

As discussed above, different lenses 12 can be releasably connected to the housing 14. FIGS. 9-11 show an exemplary embodiment of a lens 412 having a base 414 with an outer surface facing an open environment and an inner surface facing the interior of the housing 14. The outer surface of the base 414 includes a first set of optical features 416A and the inner surface includes a second set of optical features 416B. The first and second optical features 416A, 416B are used to direct and/or diffuse light. In an exemplary embodiment, the first and second optical features 416A, 416B include serrations having a tapering, angled surface. The serrations face a first direction on a first portion of the lens and a second direction on a second portion of the lens, with the size of the serrations growing from substantially the center of the lens to the outer portion, with the serrations being symmetrical about a center axis.

The lens 412 includes a pair of arms 418 extending from the base 114. The arms 418 have a first section 420 extending at an oblique angle to the base 114. A notch 422 is formed in the first section 420. As shown in FIG. 9, the angle of the first section 420 separates the first section 420 from the housing 14, allowing space to assist with the removal of the lens 412. The notch 422 can also assist a user in removing the lens, for example by hand or by using a tool having a flat edge. The arm further includes a second portion 424 that mates with the V-shaped protrusion 32 of the housing 14. The second portion 424 includes a first angled portion 426 and a second angled portion 428 at least partially defining a groove 430 The first and second angled portions 426, 428 can be connected by a curved transition and the groove 430 can have a curved base that allows it to be securely held in place by, but removed from, the V-shaped protrusion 32.

Figure 12:
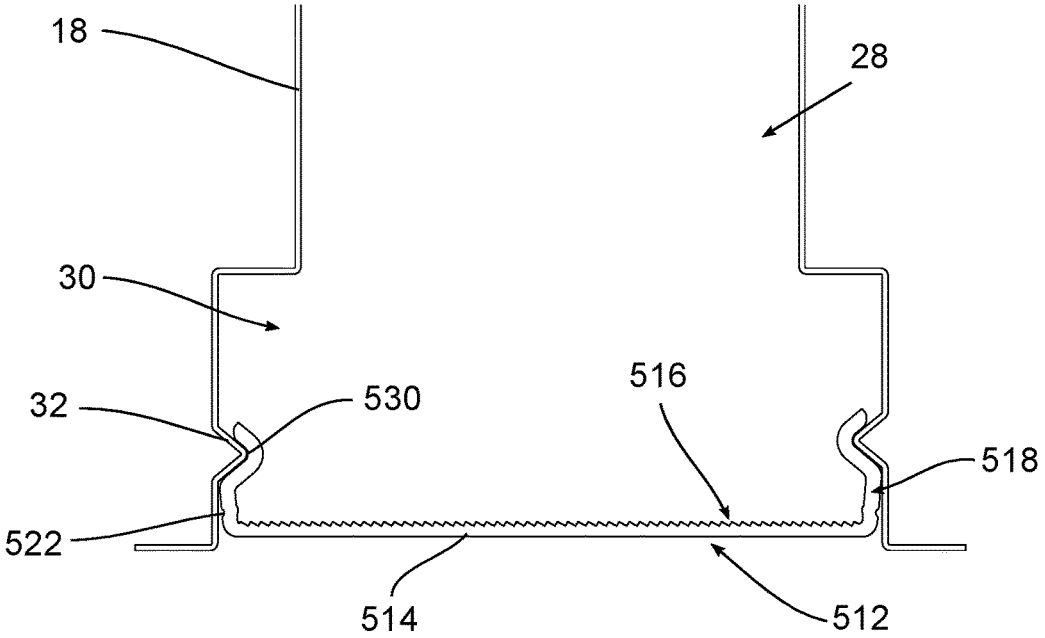
FIG. 12 is a side, sectional view of the housing and another exemplary lens.
Figure 13:
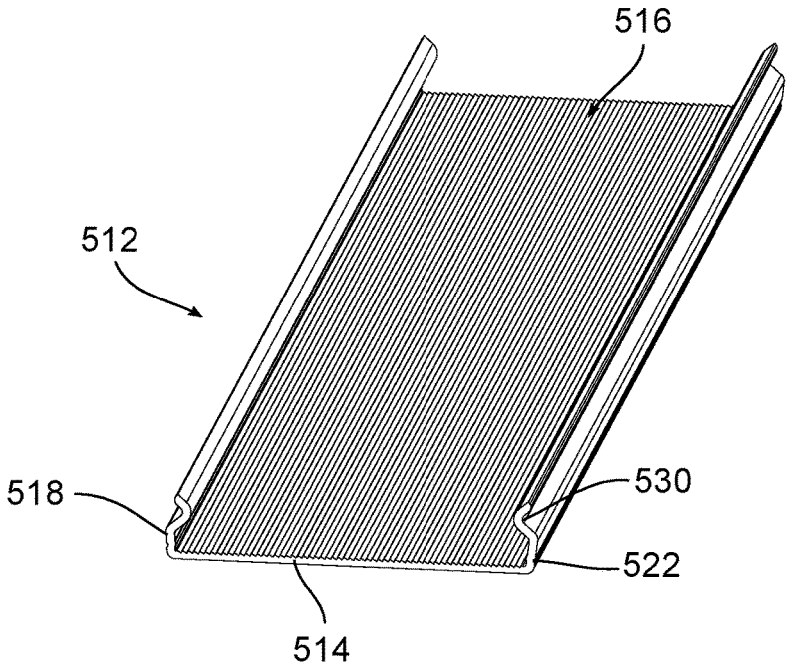
FIG. 13 is a top perspective view of the lens of FIG. 12.
Figure 14:
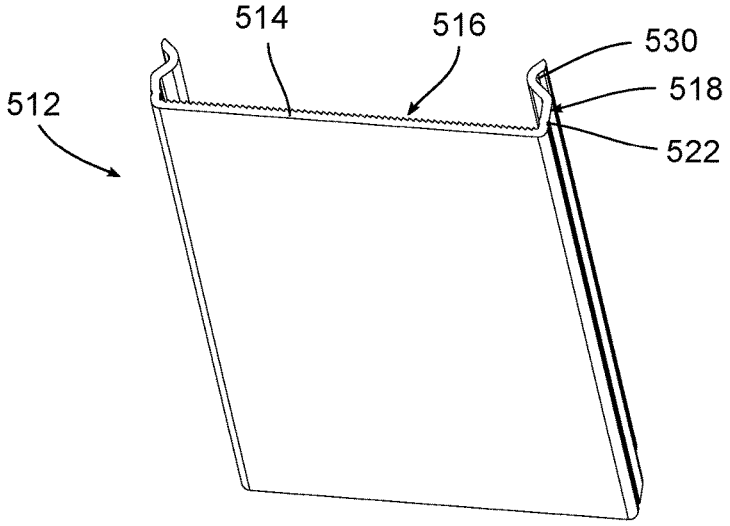
FIG. 14 is a bottom perspective view of the lens of FIG. 12.

FIGS. 12-14 show an exemplary embodiment of a lens 512 having a base 514 with an outer surface facing an open environment and an inner surface facing the interior of the housing 14. The outer surface of the base 514 is substantially planar and the inner surface includes a set of optical features 516. The optical features 516 include serrations having a tapering, angled surface. The serrations face a single direction and have a substantially uniform size.

The lens 512 includes a pair of arms 518 extending from the base 514. The arms 518 have a substantially identical configuration to the arms 418 shown in FIGS. 9-11. For example, the arms 518 include a notch 522 and a groove 530 to assist in removal and attachment of the lens 512.

Figure 15:
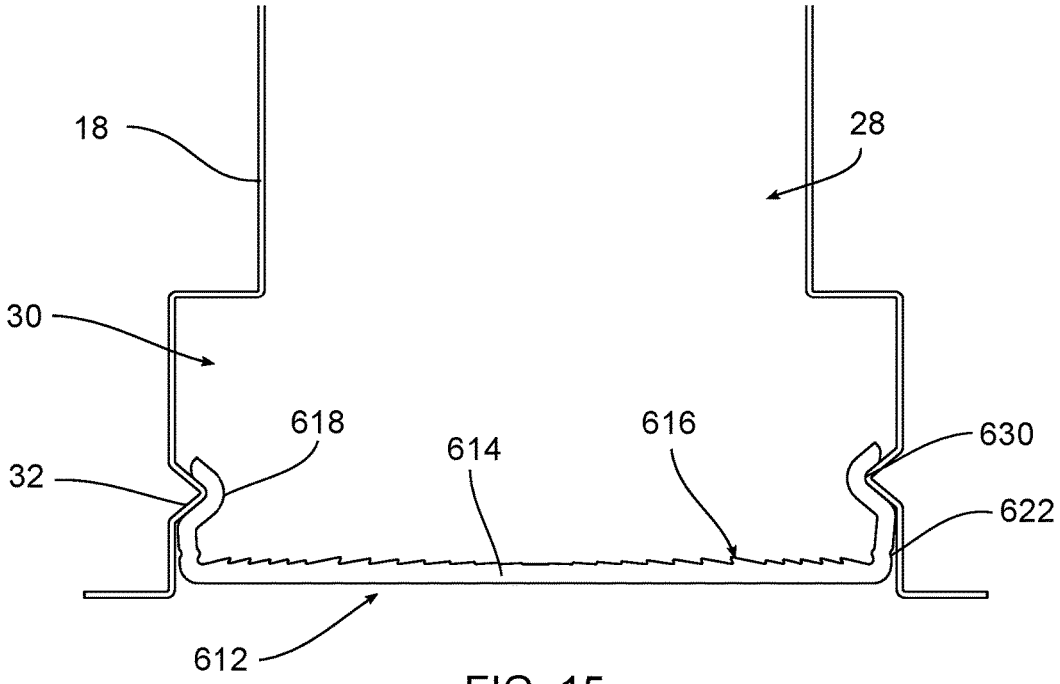
FIG. 15 is a side, sectional view of the housing and another exemplary lens.
Figure 16:
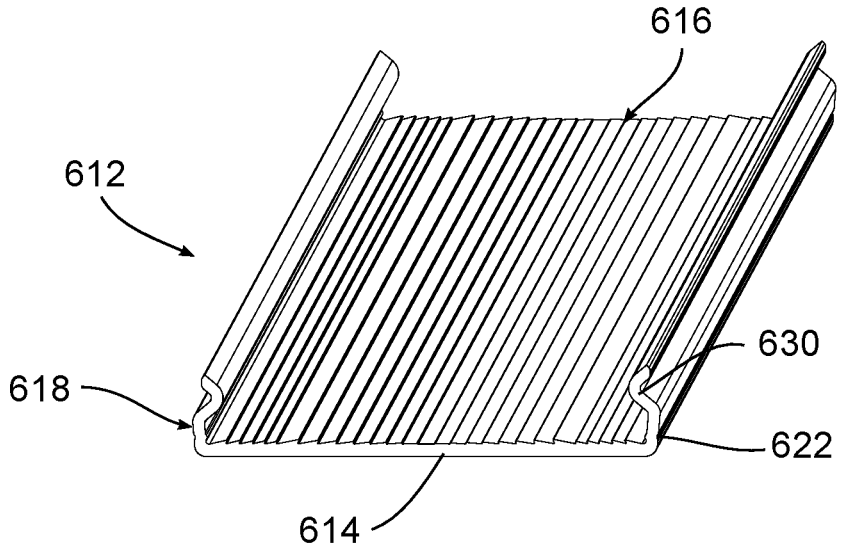
FIG. 16 is a top perspective view of the lens of FIG. 15.
Figure 17:
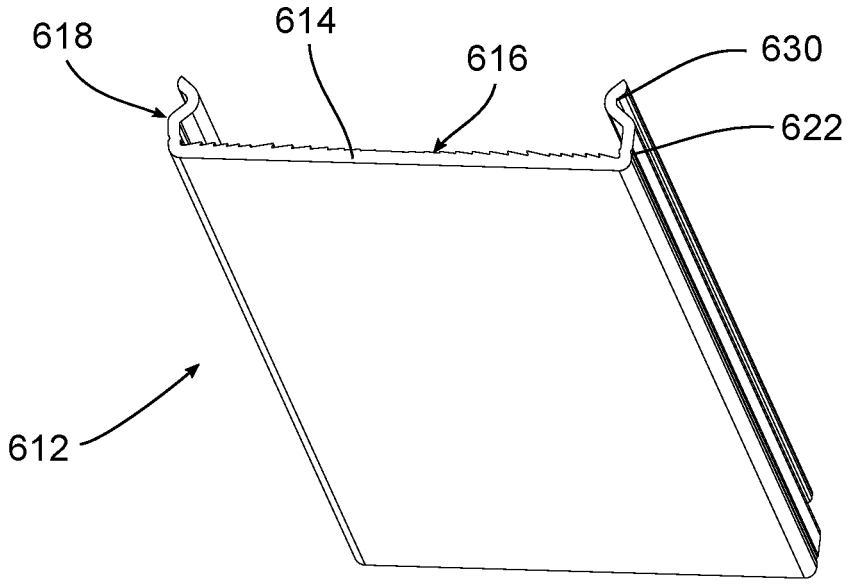
FIG. 17 is a bottom perspective view of the lens of FIG. 15.

FIGS. 15-17 show an exemplary embodiment of a lens 612 having a base 614 with an outer surface facing an open environment and an inner surface facing the interior of the housing 14. The outer surface of the base 614 is substantially planar and the inner surface includes a set of optical features 616. The optical features 616 include serrations having a tapering, angled surface. The serrations face a first direction on a first portion of the lens 612 and a second direction on a second portion of the lens 612. The size of the serrations grow from substantially the center of the lens to the outer portion, with the serrations being symmetrical about a central axis.

The lens 612 includes a pair of arms 618 extending from the base 614. The arms 618 have a substantially identical configuration to the arms 418 shown in FIGS. 9-11. For example, the arms 618 include a notch 622 and a groove 630 to assist in removal and attachment of the lens 612.

According to various exemplary embodiments, the lenses 412, 512, 612 mounting feature connects the lens to the housing 14 without any other attachment such as screws, bolts, clips, snap-connectors etc. The lenses 412, 512, 612 can therefore be field mounted and field changed by hand without the use of any special tools or dedicated tools. For example, while a tool such as a knife or screwdriver may be used to remove the lenses 412, 512, 612, a specific tool is not needed to remove any screws or other fasteners. Positioning the control components in the upper section 28 also allows the lens to be changed without exposure to a high voltage connection of component, such as a high voltage connection between a driver and the power supply.

Figure 18:
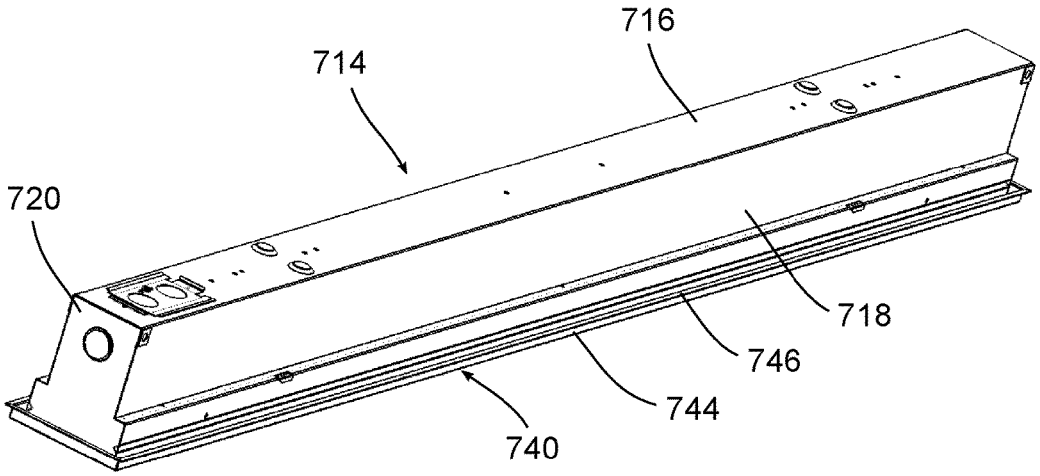
FIG. 18 is a to perspective view of an exemplary light fixture housing having an integral trim frame.
Figure 19:
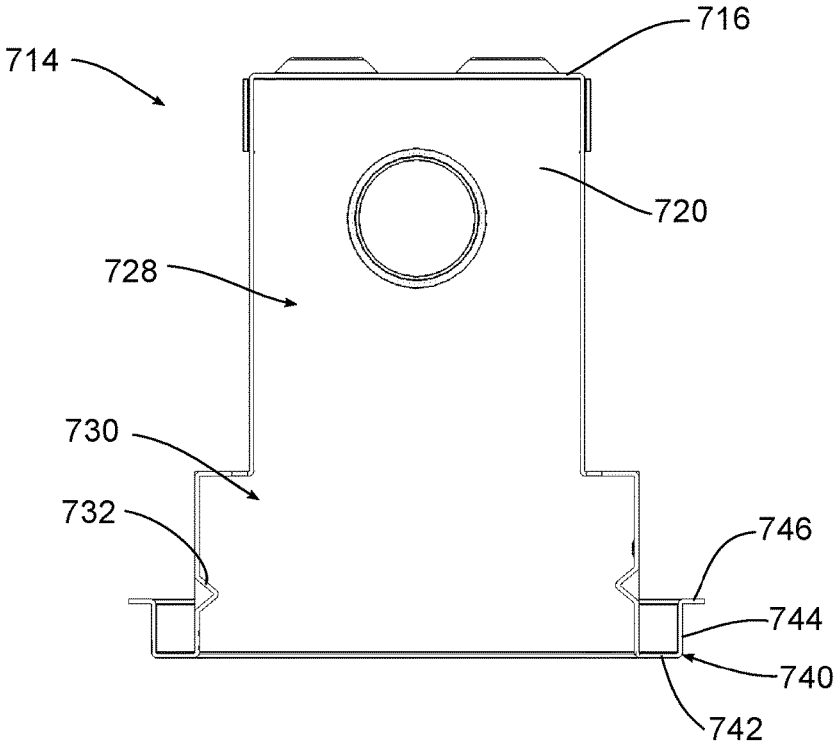
FIG. 19 is a side, sectional view of the housing of FIG. 18.

FIGS. 18 and 19 show an exemplary embodiment of a housing 714 having one or more upper walls 716, one or more side walls 718, and one or more end walls 720 at least partially defining an interior and an opening. The upper wall 716 and the side walls 718 each have a rectilinear configuration and are oriented at right angles to form a substantially elongated rectangular housing 714. The top wall 716, side walls 718, and end walls 720 can be integrally formed. The housing 714 has an upper section 728 and a lower section 730 that is wider than the upper section 728. The upper section 728 can include one or more control components, such as drivers to power the light emitters. The lower section 730 includes a mounting feature for releasably connecting a lens to the housing 714. In an exemplary embodiment, the mounting feature is a V-shaped protrusion 732 that includes a first angled wall and a second angled wall extending from the side wall 718 into the interior of the housing 714.

According to exemplary embodiments, the side walls include an integral trim frame portion 740. As best shown in FIG. 21, a first section 742 extends from the bottom or other lower portion of the side wall 718 out from the lower section 730. A second section 744 extends from the first section 742 toward the top wall 716. A third section 746 extends from the second section away from the side wall 718. The first section 742, the second section 744, and the side wall 718 at least partially define a cavity and the third section 746 acts as a flange to support the housing 714 on a mounting frame, eliminating the need for a separate trim frame. The first section 742 is shown extending substantially perpendicular to the lower portion of the side wall 718, the second section 744 is shown extending substantially perpendicular to the first portion 742, and the third portion 746 is shown extending substantially perpendicular to the second portion 744, although other configurations can be used.

Various exemplary embodiments are also directed to a method of selecting and assembling a wall wash light fixture. For example, a user can select any combination of mounting brackets and lenses discussed above to create a certain light output. After the selection is made, the desired components can be assembled at a factory or the components can be shipped to a desired location. The components can then be installed and/or assembled in the field. For example, the housing can be installed, a desired mounting bracket can be connected to the housing, and then a desired lens can be connected to the housing. If changes to the light output are needed after an initial assembly, the lens can be removed without the use of a dedicated tool and replaced with a different lens.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A method of assembling a wall wash light fixture comprising:

selecting a housing from one or more housing types;

selecting a light emitter mounting bracket from a plurality of mounting brackets, wherein the different mounting brackets are associated with different light output directions;

selecting a lens from a plurality of lenses, wherein the different lens are associated with different light outputs;

connecting the mounting bracket to the housing; and connecting the lens to the housing, wherein the lens is connected and removably secured without the use of a dedicated tool.

2. The method of claim 1, wherein selecting a light emitter mounting bracket includes selecting from a group including a mounting bracket configured to emit light substantially downward from the housing orthogonal to a major surface of the lens.

3. The method of claim 1, wherein selecting a light emitter mounting bracket includes selecting from a group including a mounting bracket configured to emit light at an oblique angle relative to a major surface of the lens.

4. The method of claim 1, wherein selecting a light emitter mounting bracket includes selecting from a group including a mounting bracket configured to emit light at a first oblique angle relative to a major surface of the lens and a second oblique angle relative to the major surface of the lens, wherein the second oblique angle is opposite the first oblique angle.

5. The method of claim 1, further comprising positioning a driver in the housing, wherein the driver is inaccessible to a user when changing the lens.

6. The method of claim 1, wherein the housing includes a V-shaped protrusion configured to mate with the selected lens.

7. The method of claim 1, wherein selecting a lens includes selecting from a group including a lens having an outer surface with a first set of serrations and an inner surface with a second set of serrations.

8. The method of claim 7, wherein the size of the serrations grow from a center of the lens toward an outer portion.

9. The method of claim 1, wherein selecting a lens includes selecting from a group including a lens having a substantially planar outer surface and an inner surface with a set of serrations.

10. The method of claim 9, wherein the serrations face a first direction on a first portion of the lens and face a second direction on a second portion of the lens.

11. A method of modifying the light output of a wall wash light fixture comprising:

removing a first lens having a first light distribution from a housing without the use of a dedicated tool; and connecting a second lens having a second light distribution to the housing without the use of a dedicated tool, wherein the housing includes an upper wall, a first side wall, and a second side wall at least partially defining an interior, wherein the first side wall and the second side wall each include a first mounting feature having a projection extending into the interior, and wherein the lens includes a base, a first arm extending from the base, and a second arm extending from the base, wherein the first and second arms each include a second mounting feature configured to mate with the first mounting feature to releasably connect the lens to the housing.

12. The method of claim 11, wherein the first mounting feature includes a V-shaped projection.

13. The method of claim 12, wherein the second mounting feature includes a groove.

14. The method of claim 11, wherein the first lens or the second lens has an outer surface with a first set of serrations and an inner surface with a second set of serrations.

15. The method of claim 14, wherein the size of the first and second serrations grow from a center of the lens toward an outer portion.

16. The method of claim 14, wherein the first and second serrations face a first direction on a first portion of the lens and face a second direction on a second portion of the lens.

17. The method of claim 14, wherein the first set of serrations have an angled, tapered surface.

18. The method of claim 11, wherein selecting a lens includes selecting from a group including a lens having a substantially planar outer surface and an inner surface with a set of serrations.

19. The method of claim 18, wherein the serrations face a first direction on a first portion of the lens and face a second direction on a second portion of the lens.

20. The method of claim 11, wherein a driver is positioned in the housing and is inaccessible to a user when changing the lens.

* * * * *